US008373051B2

(12) United States Patent
Gillis

(10) Patent No.: US 8,373,051 B2
(45) Date of Patent: Feb. 12, 2013

(54) SYSTEM FOR ADDING A STRING TO A STRINGED INSTRUMENT

(76) Inventor: Harald Gillis, Emmen (NL)

( * ) Notice: Subject to any disclaimer, the term of this patent is extended or adjusted under 35 U.S.C. 154(b) by 68 days.

(21) Appl. No.: 12/989,146

(22) PCT Filed: Apr. 24, 2009

(86) PCT No.: PCT/NL2009/000102

§ 371 (c)(1),
(2), (4) Date: Dec. 10, 2010

(87) PCT Pub. No.: WO2009/131441

PCT Pub. Date: Oct. 29, 2009

(65) Prior Publication Data

US 2011/0283861 A1 Nov. 24, 2011

(30) Foreign Application Priority Data

Apr. 24, 2008 (NL) ..... 1035345
Aug. 26, 2008 (NL) ..... 1035868

(51) Int. Cl.
*G10D 3/14* (2006.01)

(52) U.S. Cl. ..... 84/304; 84/297 R; 84/329; 84/327

(58) Field of Classification Search ..... 84/297 R, 84/304, 329
See application file for complete search history.

(56) References Cited

U.S. PATENT DOCUMENTS

| | | | | | |
|---|---|---|---|---|---|
| 331,751 | A * | 12/1885 | Angus | 84/329 |
| 494,025 | A * | 3/1893 | Pettersson | 84/274 |
| 572,677 | A * | 12/1896 | Goodwin | 84/297 R |
| 1,371,506 | A * | 3/1921 | Marx | 84/319 |
| 1,452,384 | A * | 4/1923 | Kissendorfer | 269/182 |
| 2,510,799 | A * | 6/1950 | Carley | 84/327 |
| 3,486,408 | A * | 12/1969 | Gross | 84/267 |
| 3,704,014 | A * | 11/1972 | Keene | 269/249 |
| 5,747,712 | A * | 5/1998 | Goto | 84/306 |
| 5,753,838 | A * | 5/1998 | Vanga, II | 84/297 R |
| 5,962,797 | A * | 10/1999 | Spercel et al. | 84/297 R |
| 6,098,973 | A * | 8/2000 | Khachatoorian | 269/182 |
| 6,533,605 | B1 * | 3/2003 | Reuter | 439/431 |
| D485,739 | S * | 1/2004 | Carrico et al. | D8/73 |
| 7,554,022 | B2 * | 6/2009 | Matsubara | 84/298 |
| 7,659,465 | B1 * | 2/2010 | McEwen | 84/304 |
| 7,973,225 | B2 * | 7/2011 | Goto | 84/306 |
| 8,141,839 | B2 * | 3/2012 | Buchner | 248/516 |
| 2012/0222538 | A1 * | 9/2012 | Booth | 84/304 |

* cited by examiner

*Primary Examiner* — David Warren
*Assistant Examiner* — Robert W Horn
(74) *Attorney, Agent, or Firm* — Robert A. Jensen; Jensen & Puntigam, P.S.

(57) ABSTRACT

The invention relates to a system for adding a string to a stringed instrument, consisting of an additional string and an additional tuning machine which can be clamped onto the head of the stringed instrument using a clamping member. The system moreover preferably comprises a hooking member to which the string can be hooked, and fixing means for fixing the hooking member to the stringed instrument.

10 Claims, 6 Drawing Sheets

SYSTEM FOR ADDING A STRING TO A STRINGED INSTRUMENT

TECHNICAL FIELD

The invention relates to a method for adding a string to a stringed instrument such as a guitar, wherein a tuning machine is attached to a head of the stringed instrument, after which the string is tensioned between the tuning machine and a bridge of the stringed instrument.

BACKGROUND OF THE INVENTION

A method of adding a string is known. An extra hole is here drilled into the head, after which the tuning machine is fixed in this hole. One side of the added string is here tensioned substantially parallel to an existing string, wherein the added string is tuned such that the sound is precisely an octave higher than the existing string. The other side of the added string is secured with an added string pin, for which purpose an extra hole must likewise be drilled. A surprisingly warm sound can in this way be obtained, for instance when playing a chord. The drawback of the known method is that the stringed instrument is irreversibly modified, whereby it loses value.

SUMMARY OF THE INVENTION

The method according to the invention obviates this drawback, and has the feature that the tuning machine is attached to a clamping member, and that the clamping member is clamped onto the head. It is then easily possible to remove the tuning machine again without this leaving marks. The other side of the added string is preferably secured together with the existing string using the string pin associated with the existing string, so that it is not necessary here either to drill an extra hole. It is also possible to add a separate fixing member for the added string, this member being hooked instance behind the existing string pins.

A favourable realization of the inventive method has the feature that a body of the stringed instrument is provided with a nipple under which the string can be hooked. It hereby becomes possible, even during playing of the stringed instrument, to optionally cause the added string to co-resonate when for instance a chord is played. The nipple can be secured directly in a body of the stringed instrument, for which purpose a very small hole has to be drilled into the body, although preferably the nipple is secured using a fixing strip which is hooked into a sound hole of the stringed instrument or which is adhered releasably to the body.

The invention also relates to a system for adding one or more strings to a stringed instrument, comprising one or more first fixing members intended for co-action with the saddle of the stringed instrument for the purpose of releasable attachment of a first outer end of the one or more strings, one on more additional tuning machines intended for the purpose of attaching the second outer end of the one or more strings and tuning thereof, one or more second fixing members intended for releasable co-action with the head of the stringed instrument for the purpose of fixing the one or more additional tuning machines. The first and second fixing members are preferably embodied such that they can be mounted without damage and removed without the possibility of damage to the stringed instrument.

A preferred embodiment of the system according to the invention is also provided with one or more hooking members, as well as fixing means for fixing the one or more hooking members to the stringed instrument, which hooking members are adapted such that, when hooked to the hooking member, a string is situated substantially between the body of the stringed instrument and the plane of the other strings. The hooking member is preferably placed here such that the vibration of the added string is not possible in the hooked position. The added string can in effect be activated or, on the contrary, deactivated by optionally hooking on the added string.

In a further development of the above stated preferred embodiment the hooking member comprises adjusting means for adjusting the position of the hooked-on string relative to the plane of the other strings. Since the height of the strings relative to the frets can vary per stringed instrument, such as a guitar, using this measure the hooking member can be adjusted in simple manner such that the hooked string comes to lie substantially flat on the frets of the neck.

In a favourable embodiment of the system according to the invention the second fixing member comprises a clamping member which can be clamped onto the head of the stringed instrument and is provided with the additional tuning machine or with an opening in which the additional tuning machine can be attached. In an embodiment with an opening, the opening is preferably formed by a slotted hole, whereby it becomes possible to select the position of the tuning machine subject to the wishes of the user.

In a further very favourable embodiment of the system according to the invention the clamping member comprises a chamber provided with a pressing plate and a pressing screw which can press the pressing plate out of the chamber. The force exerted by the pressing screw is distributed over a relatively large area by the pressing plate, thereby substantially precluding damage to the head of the stringed instrument. The clamping surfaces of the clamping member can further be covered with for instance felt, whereby damage to the head can certainly not occur. The felt can moreover then ensure that the plate does not drop out of the chamber.

In a further, easily realized embodiment the hooking member comprises a toadstool-shaped nipple provided with a tubular piece of damping material such as felt or rubber. When the string is now hooked on, the string is then also effectively damped, so that substantially no sound is produced in the case of incidental contact.

In a further favourable embodiment the fixing means comprise a strip which can be clamped into a sound hole of the stringed instrument. It is in this way possible to arrange and remove the nipple quickly and easily without irreversibly modifying the stringed instrument. The required clamping can for instance be obtained by providing the peripheral side of the strip with a groove, or by embodying the strip as an assembly of two part-strips which are pulled toward each other using screws or springs.

In a favourable alternative embodiment, which can be utilized in a stringed instrument not provided with a sound hole, the fixing means comprise a strip provided on an underside with adhesive means which can be adhered to the stringed instrument. It is then also possible in this way to arrange and remove the nipple quickly and easily without irreversibly modifying the stringed instrument.

In a further favourable embodiment the first fixing member is provided with at least one opening which comprises at least one string pin of the stringed instrument. In this manner the stringed instrument need not be modified for the purpose of securing the first fixing member.

The invention also relates to a stringed instrument provided with a system as specified in the foregoing paragraphs.

The invention also relates to a first fixing member as part of a system as specified in the foregoing paragraphs.

The invention also relates to a second fixing member and additional tuning machine as part of a system as specified in the foregoing paragraphs.

The invention also relates to a hooking member and fixing means as part of a system as specified in the foregoing paragraphs.

BRIEF DESCRIPTION OF THE DRAWINGS

The invention will now be further elucidated on the basis of the following figures, wherein:

FIG. 5A shows a schematic cross-section of a stringed instrument with a string which is not hooked on;

FIG. 5B shows a schematic cross-section of this stringed instrument with a string which is hooked on;

BEST MODE FOR CARRYING OUT THE INVENTION

Figure 1:
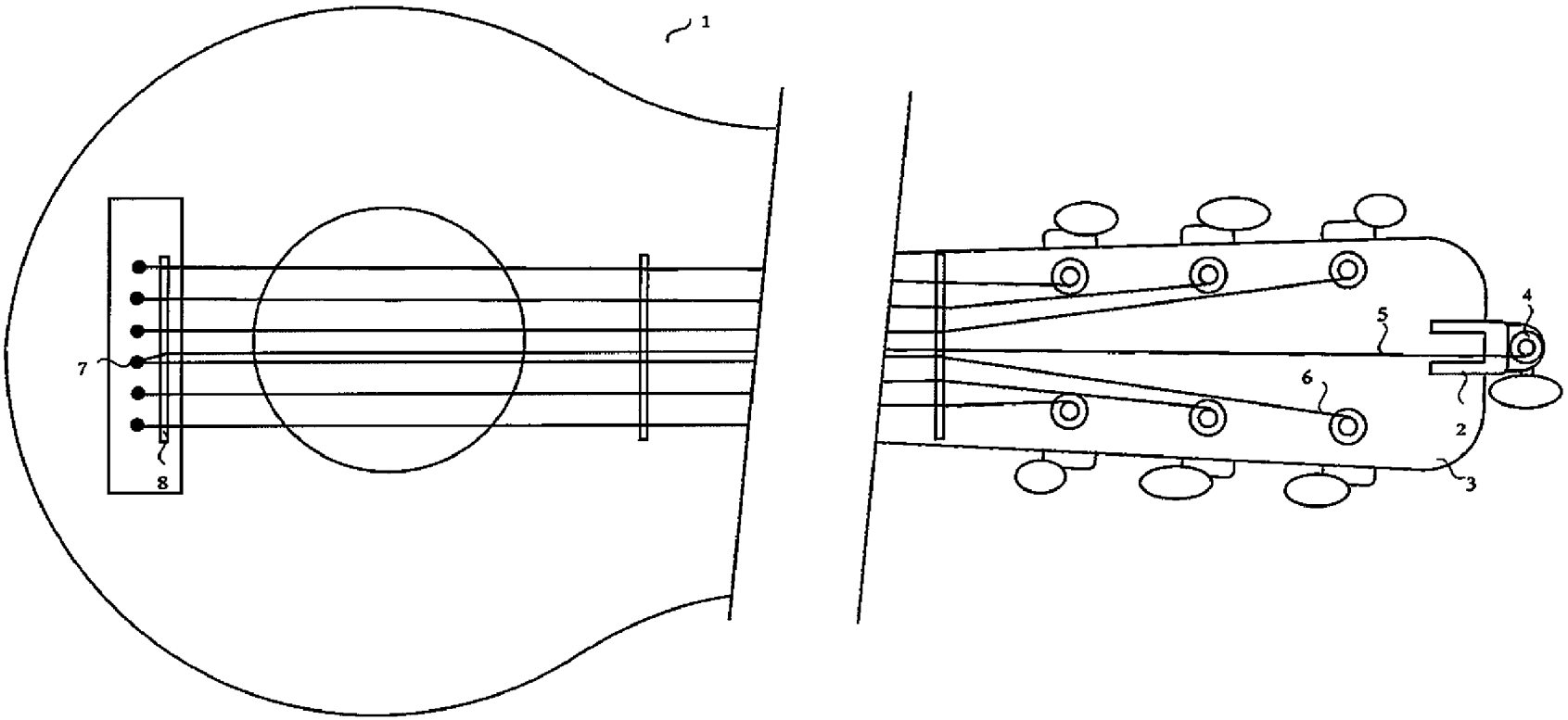
FIG. 1 shows schematically a stringed instrument provided with a clamping member according to the invention.

FIG. 1 shows schematically a stringed instrument 1 provided with a clamping member 2 according to the invention which is clamped onto the head 3 of stringed instrument 1. Clamping member 2 is provided with a standard tuning machine 4 with which a string 5 that has been added to stringed instrument 1 can be tensioned. In the case of a guitar, string 5 runs for instance along the G-string 6 and is tuned an octave higher. It is then struck simultaneously with G-string 6 and imparts a surprisingly warm tone to G-string 6. The other side of string 5 is secured together with G-string 6 using a string pin 7. If desired, a groove can be arranged in a bridge saddle 8 for the purpose of separating string 5 relative to G-string 6. It is possible to rotate tuning machine 4 through a quarter turn, for instance because convenience of use is hereby improved or because the stringed instrument then fits better into its case.

Figure 2A:
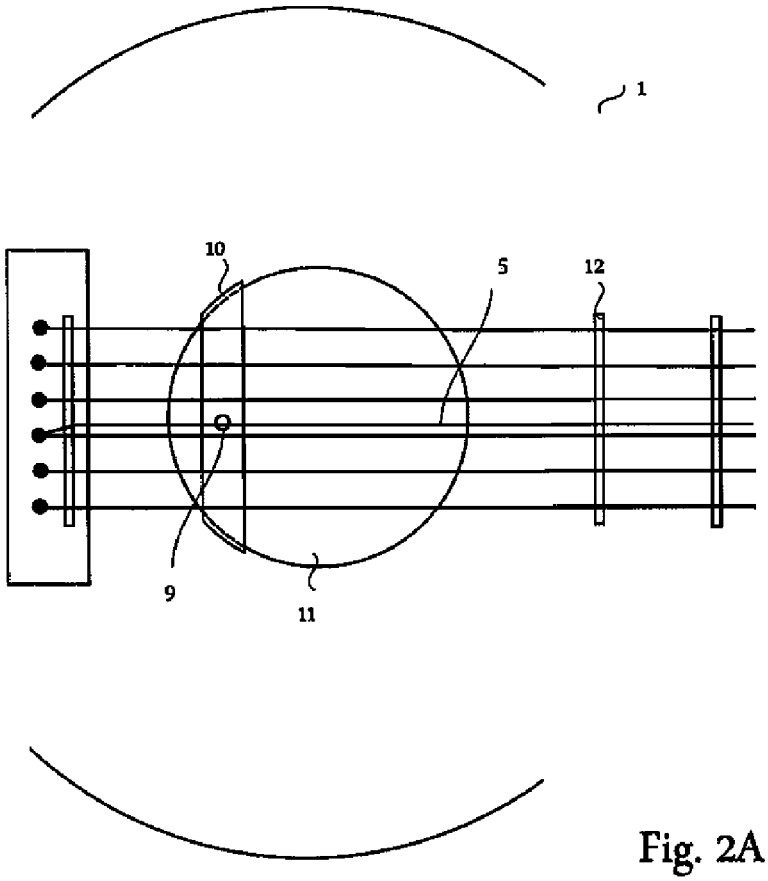
FIG. 2A shows schematically a stringed instrument provided with a hooking member according to the invention.

FIG. 2A shows schematically a stringed instrument 1 provided with a hooking member 9 according to the invention behind which string 5 can be hooked when it is wished to play the stringed instrument with an unchanged sound. Hooking member 9 consists here of a toadstool-shaped object mounted in a strip 10 of for instance wood or plastic, this strip 10 being clamped in a sound hole 11 of stringed instrument 1. String 5 is pulled by hooking member 9 against frets 12 of the stringed instrument, and can then no longer resonate. It is easily possible during playing of stringed instrument 1 to hook string 5 behind hooking member 9 or, conversely, to release it so that the timbre of the stringed instrument can be changed during playing.

Figure 2B:
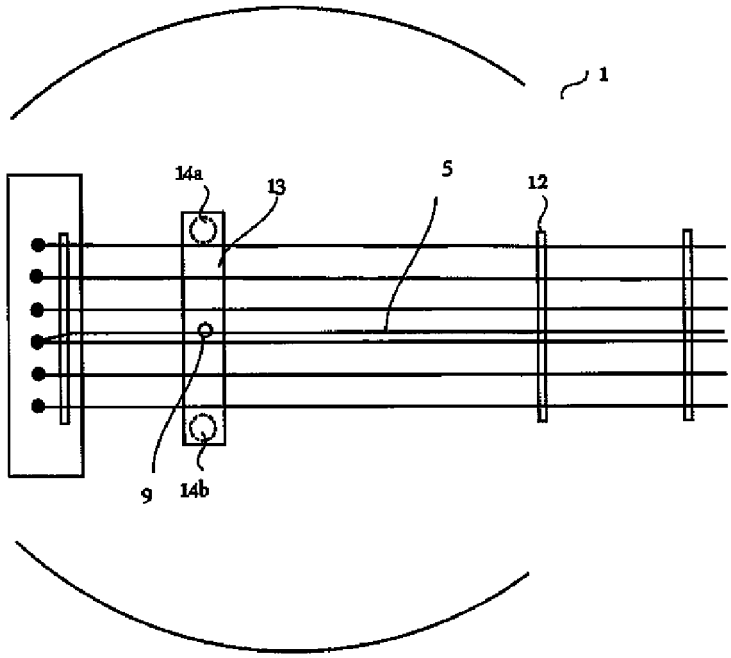
FIG. 2B shows schematically a stringed instrument provided with an alternative hooking member according to the invention.

FIG. 2B shows schematically a stringed instrument 1 provided with an alternative hooking member 9 according to the invention behind which string 5 can be hooked if it is wished to play stringed instrument 1 with an unchanged sound. Hooking member 9 consists here of a toadstool-shaped object mounted in a strip 13, this strip 13 being provided on the underside with adhesive pads 14*a*,14*b* with which strip 13 can be adhered to stringed instrument 1 and, if desired, released therefrom again without damaging stringed instrument 1. String 5 is pulled by hooking member 9 against frets 12 of the stringed instrument and can then no longer resonate. It is easily possible during playing of stringed instrument 1 to hook string 5 behind hooking member 9 or, conversely, to release it so that the timbre of the stringed instrument can be changed during playing.

Figure 3A:
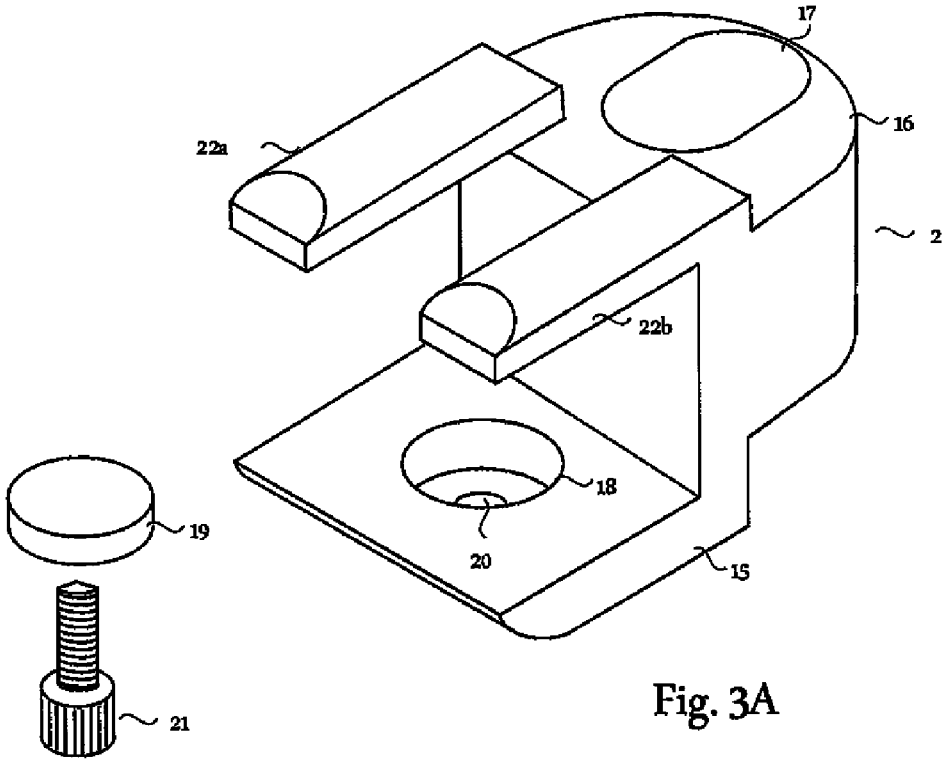
FIG. 3A shows schematically a possible embodiment of a clamping member according to the invention.

FIG. 3A shows schematically a possible embodiment of a clamping member 2 according to the invention. Clamping member 2 consists of a part 15 of U-shaped cross-section manufactured from metal or plastic which can be pushed around head 3 of stringed instrument 1 and a mounting plate 16 on which a tuning machine 4 can be mounted. Mounting plate 16 is provided for this purpose with a hole 17, which is embodied here as slotted hole so that tuning machine 4 can be mounted in different positions. The part of U-shaped part 15 situated under head 3 in a position of use is provided with a chamber 18 in which a plate 19 can be received, and with a hole 20 provided with a screw thread in which a fastening screw 21 can be screwed which presses plate 19 against head 3. The part of U-shaped part 15 situated above head 3 in a position of use is preferably given a light and decorative form, and consists for instance of two fingers 22*a*,22*b*.

Figure 3B:
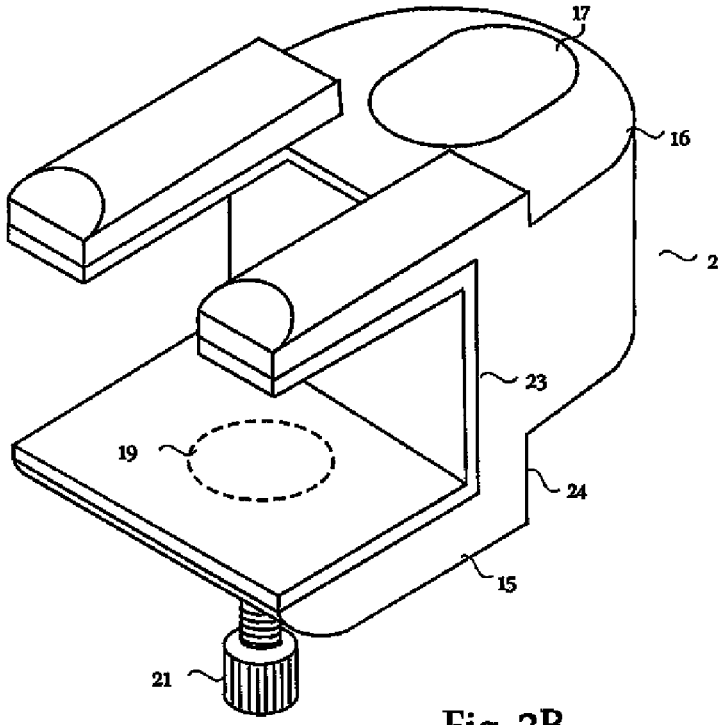
FIG. 3B shows this clamping member in assembled position.

FIG. 3B shows this clamping member 2 in assembled state, wherein the inner side of U-shaped part 15 is moreover covered with a layer 23, manufactured for instance from felt, which prevents head 3 being damaged and furthermore prevents plate 19 dropping out of chamber 18. Also shown is an upright edge 24 which forms a stop for a tuning machine to be mounted, so that this tuning machine cannot be displaced by the tensioned string. It is of course also possible to integrate a tuning machine into clamping member 2, wherein it is not necessary to arrange a slotted hole. An adjustment option is however hereby lost.

Figure 4A:
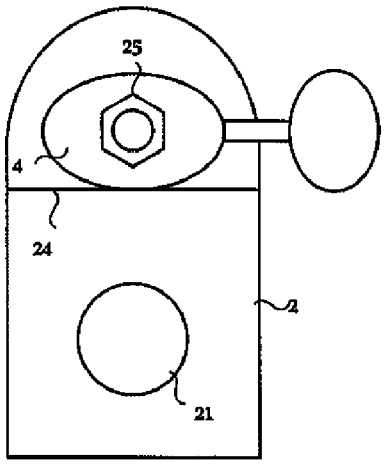
FIG. 4A shows schematically a clamping member with a tuning machine mounted transversely thereon.

FIG. 4A shows schematically a clamping member 2 with a tuning machine 4 mounted transversely thereon. Tuning machine 4 is inserted through slotted hole 17 and displaced such that it rests against edge 24, after which it is secured with a nut 25.

Figure 4B:
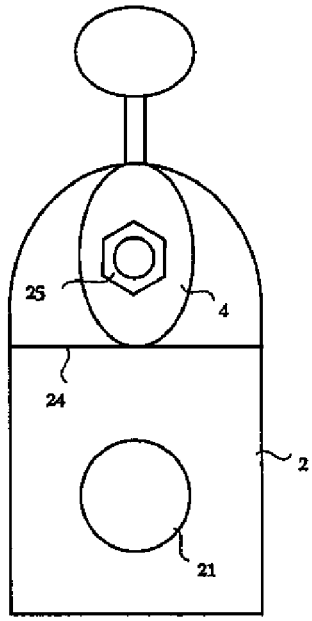
FIG. 4B shows schematically a clamping member with a tuning machine mounted in a longitudinal direction.

FIG. 4B shows schematically a clamping member 2 with a tuning machine 4 mounted in a longitudinal direction. In this position tuning machine 4 is also inserted through slotted hole 17 and displaced such that it rests against edge 24, after which it is secured with a nut 25.

Figure 4C:
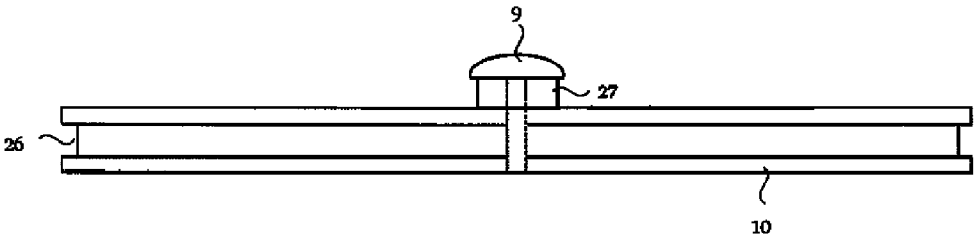
FIG. 4C shows a schematic side view of the hooking member of FIG. 2A.

FIG. 4C shows a schematic side view of hooking member 9 of FIG. 2A mounted on a strip 10 which can be clamped into a sound hole 11 of stringed instrument 1. Strip 10 is provided for this purpose on its periphery with a groove 26 into which an edge of sound hole 11 will fit in a position of use. Hooking member 9 here takes a toadstool-shaped form and is provided with a ring 27 manufactured from felt or other type of damping material, thereby preventing string 5 producing a sound when it is hooked on. It is of course also possible to assemble strip 10 from two or three separate layers which, using screws or springs, can be clamped onto each other in order to fix strip 3 in sound hole 11.

Figure 4D:
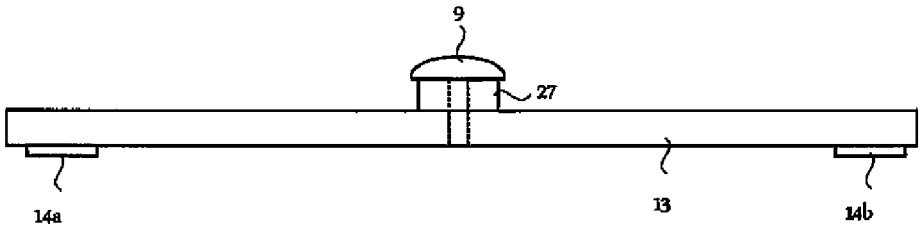
FIG. 4D shows a schematic side view of the hooking member of FIG. 2B.

FIG. 4D shows a schematic side view of hooking member 9 of FIG. 2B mounted on a strip 13 provided with two adhesive pads 14*a*,14*b* with which it can be adhered to string instrument L Hooking member 9 here takes a toadstool-shaped form and is provided with a ring 27 manufactured from felt or other type of damping material, thereby preventing string 5 producing a sound when it is hooked on.

Figure 5A:
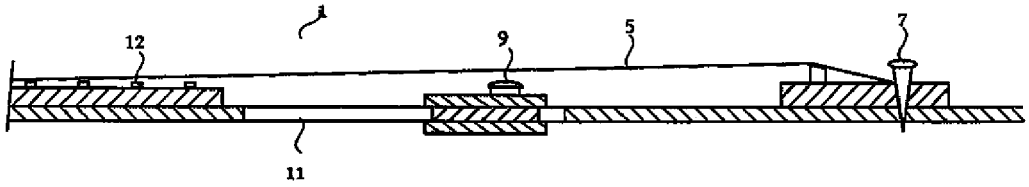

FIG. 5A shows a schematic cross-section of a stringed instrument 1 with a string 5 which is not hooked on. String 5 runs clear over frets 12 from tuning machine 4 to string pin 7 and passes a good distance over hooking member 9 mounted on strip 10.

Figure 5B:
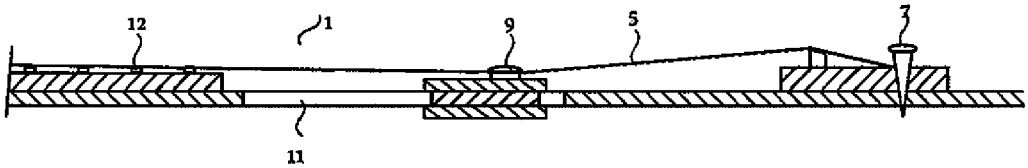

FIG. 5B shows a schematic cross-section of this stringed instrument with a string 5 which is hooked on. String 5 is now pulled by hooking member 9 onto frets 12 so that it can no longer vibrate.

Figure 5C:
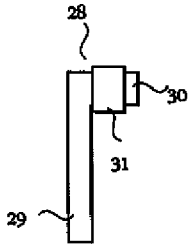
FIG. 5C shows a schematic side view of an alternative hooking member.

FIG. 5C shows a schematic side view of an alternative hooking member 28. Hooking member 28 consists of a mounting pin 29 and a hook 30, and is preferably manufactured from metal. A tube 31 of damping material is arranged around hook 30 in order to damp vibrations in string 5.

Figure 5E:
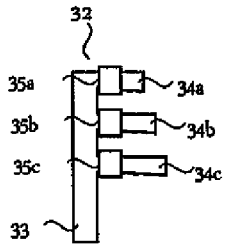
FIG. 5E shows a schematic side view of a further alternative hooking member.
Figure 5D:
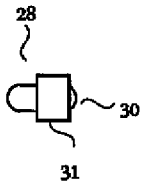
FIG. 5D shows a top view of this hooking member.

FIG. 5D shows a top view of hooking member 28, with hook 30 and tube 31.

FIG. 5E shows a schematic side view of a further alternative hooking member 32. Hooking member 32 consists of a mounting pin 33 and three hooks 34*a*,34*b*,34*c*, and is preferably manufactured from metal. Tubes 35*a*,35*b*,35*c* of damping material are arranged around hooks 34*a*,34*b*,34*c* in order to damp vibrations in string 5. The advantage is that hooking member 32 can be placed on substantially any stringed instrument because one of the hooks 34*a*,34*b*,34*c* will always be situated at a comfortable height.

Figure 5F:
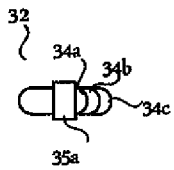
FIG. 5F shows a top view of this hooking member.

FIG. 5F shows a top view of this hooking member 32, with hooks 34*a*,34*b*,34*c* and tube 35*a*.

Figure 6A:
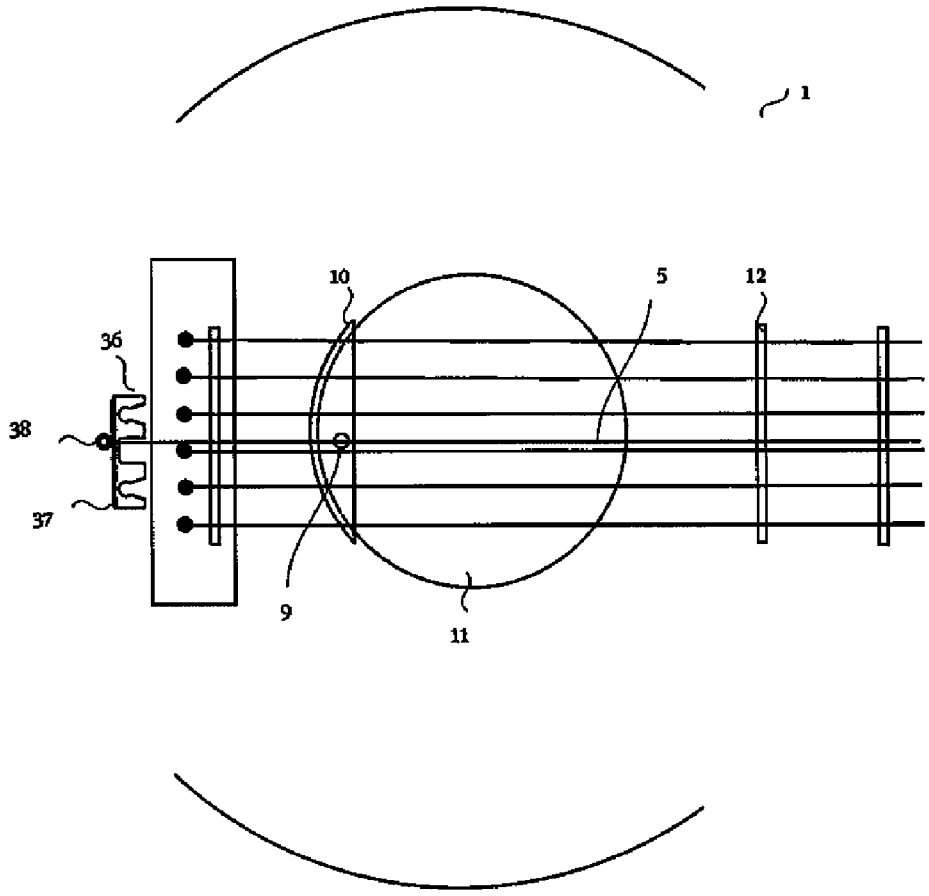
FIG. 6A shows schematically a stringed instrument provided with a fixing member.

FIG. 6A shows schematically a stringed instrument provided with a fixing member 36 for the additional string. Fixing member 36 here takes a comb-like form so that it can be pushed between the string pins. Fixing member 36 is provided with an upright edge 37 provided with a hole through which the additional string can be placed, wherein a ring 38 attached as standard to the string provides for the actual fixing. If desired, fixing member 36 can also be embodied with a number of holes through which the string pins are placed.

Figure 6B:
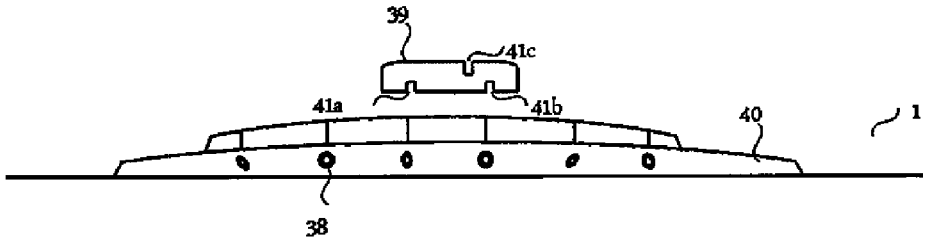
FIG. 6B shows schematically an alternative fixing member.

FIG. 6B shows schematically an alternative fixing member 39 which can be used for stringed instruments not provided with string pins. In this case the upper side of the stringed instrument is generally provided with a bridge 40 provided with drilled holes through which the strings can be placed, wherein the actual fixing is provided by rings 38 which cannot pass through the drilled holes. In this embodiment fixing member 39 is laid against bridge 40, wherein several strings drop into notches 41*a*,41*b*. The strings are then tensioned, wherein fixing member 39 is pulled firmly against bridge 40. The top side of fixing member 39 is provided with a notch 41*c* in which the additional string can now be fixed.

The invention claimed is:

1. A system for adding one string (5) to a stringed instrument (1), comprising one or more first fixing members (36; 39) intended for co-action with the saddle of the stringed instrument for the purpose of releasable attachment of a first outer end of the string, and an additional tuning machine (4) intended for the purpose of attaching the second outer end of the string and tuning thereof, a second fixing member (2) intended for releasable co-action with the head (3) of the stringed instrument for the purpose of fixing the additional tuning machine, wherein the second fixing member comprises a clamping member (2) which can be clamped onto the head (3) of the stringed instrument (1) and is provided with the additional tuning machine (4) or with an opening (17) in which the additional tuning machine can be attached, wherein the clamping member (2) consist of a part (15) of U-shaped cross-section, which can be pushed around head (3) of stringed instrument (1), and a mounting plate (16) on which the tuning machine (4) can be mounted, and wherein part (15) of U-shaped cross section comprises a chamber (18) provided with a pressing plate (19) and a pressing screw which can press the pressing plate (21) out of the chamber.

2. A system as claimed in claim 1, wherein the first fixing member is provided with at least one opening which comprises at least one string pin (7) of the stringed instrument (1).

3. A system as claimed in claim 2, wherein the first fixing member (36) takes a comb-like form so that it can be pushed between the string pins (7).

4. A system as claimed in claim 1, wherein the first fixing member (39) is provided with notches (41*a*, 41*b*) for several strings to drop into and wherein the fixing member (39) is provided at the top side thereof with a notch (41*c*) in which the string (5) to be added can be fixed.

5. A system as claimed in claim 1, wherein the system is also provided with one or more hooking members (9; 28; 32), as well as fixing means (10; 13; 29; 33) for fixing the one or more hooking members to the stringed instrument (1), which hooking members are adapted such that, when hooked to the hooking member, a string (5) is situated substantially between the body of the stringed instrument and the plane of the other strings.

6. A system as claimed in claim 5, wherein the hooking member (32) comprises adjusting means (34*a*; 34*b*; 34*c*) for adjusting the position of the hooked-on string (5) relative to the plane of the other strings.

7. A system as claimed in claim 6, wherein the hooking member comprises a toadstool-shaped nipple (9) provided with a tubular piece (27) of damping material such as felt or rubber.

8. A system as claimed in claim 5, wherein the fixing means comprise a strip (10) which can be clamped into a sound hole (11) of the stringed instrument (1).

9. A system as claimed in claim 5, wherein the fixing means comprise a strip (13) provided on an underside with adhesive means (14*a*; 14*b*), which can be adhered to the stringed instrument (1).

10. A stringed instrument provided with a system as claimed in claim 1.

* * * * *